US007987524B2

(12) United States Patent
Bower

(10) Patent No.: US 7,987,524 B2
(45) Date of Patent: Aug. 2, 2011

(54) UPPER GARMENT FOR PATIENT

(76) Inventor: Belinda Sue Bower, Lewisville, NC (US)

( * ) Notice: Subject to any disclaimer, the term of this patent is extended or adjusted under 35 U.S.C. 154(b) by 72 days.

(21) Appl. No.: 12/384,147

(22) Filed: Apr. 1, 2009

(65) Prior Publication Data

US 2010/0251456 A1 Oct. 7, 2010

(51) Int. Cl.
*A41D 10/00* (2006.01)
*A41D 13/12* (2006.01)
*A41D 1/00* (2006.01)

(52) U.S. Cl. ..... 2/106; 2/114; 2/69

(58) Field of Classification Search ..... 2/2, 8, 67, 2/69, 75, 79, 80, 85, 86, 69.5, 94, 96, 108, 2/101, 104, 105, 106, 114, 217, 218, 227; 602/62, 64, 78; 24/306; 604/179
See application file for complete search history.

(56) References Cited

U.S. PATENT DOCUMENTS 302,901 A * 8/1884 Fenne ..... 2/114
818,351 A * 4/1906 Clark ..... 2/114
1,998,051 A * 4/1935 Gerber ..... 2/114
2,073,711 A * 3/1937 Robinsohn ..... 2/126
2,504,534 A * 4/1950 Kephart et al. ..... 2/114
2,677,826 A 5/1954 Piacenza
2,722,686 A * 11/1955 Hoskings ..... 2/74
2,736,900 A * 3/1956 Koren ..... 2/114
3,490,072 A * 1/1970 Keltner ..... 2/114
3,721,998 A * 3/1973 Meyers ..... 2/74
3,824,625 A * 7/1974 Green ..... 2/114
4,258,440 A * 3/1981 McGowan ..... 2/114
4,422,186 A * 12/1983 Loney ..... 2/114
4,570,268 A * 2/1986 Freeman ..... 2/114
4,644,589 A * 2/1987 Pettis ..... 2/109
4,698,848 A * 10/1987 Buckley ..... 2/114
4,964,173 A * 10/1990 Gordon et al. ..... 2/114
4,969,215 A * 11/1990 Burkett ..... 2/114
5,062,159 A * 11/1991 Jakub ..... 2/114
5,097,535 A * 3/1992 Dye et al. ..... 2/69
5,222,258 A * 6/1993 Mucci et al. ..... 2/114
5,325,538 A * 7/1994 Schoenweiss et al. ..... 2/2.5
5,392,466 A * 2/1995 Chou et al. ..... 2/114
5,564,123 A * 10/1996 Grassick ..... 2/69
5,564,126 A * 10/1996 Chou ..... 2/114
D381,488 S * 7/1997 Small ..... D2/720
5,642,526 A 7/1997 Thompson
(Continued)

*Primary Examiner* — Bobby H Muromoto, Jr.
(74) *Attorney, Agent, or Firm* — Stephen E. Clark

(57) ABSTRACT

A long-sleeved, pullover-type upper body garment has a continuous slit, which runs up the side of the garment from the bottom of garment body to an arm pit, and downward along the underside of a sleeve, and terminates at a point intermediately along the length of the sleeve. The segment of the slit that is in the body of the garment is temporarily closeable using mating hook-and-loop fastener members that are attached to the body of the garment on opposite sides of the slit. The segment of the slit in the upper portion of the sleeve remains at all times "open", thereby allowing access to the middle and/or upper end of the wearer's arm for attachment of IV tubing or other medical lines. The circumference of the lower end (e.g., forearm portion) of the sleeve is neither separable nor openable, thereby requiring that a wearer insert his/her hand through the lower portion of the sleeve. The garment can be donned or removed by a patient to whom mid-arm medical lines are attached, without necessitating detachment of the medical lines. Conversely, mid-arm medical lines can be attached to a wearer's arm without necessitating rolling up of the sleeve or removal of the garment.

5 Claims, 4 Drawing Sheets

U.S. PATENT DOCUMENTS

| | | | | |
|---|---|---|---|---|
| D396,339 | S * | 7/1998 | Ramsey | D2/720 |
| 5,920,904 | A | 7/1999 | Sapoznick | |
| 6,119,270 | A * | 9/2000 | Chou | 2/108 |
| D457,289 | S * | 5/2002 | Shorr | D2/720 |
| 6,484,321 | B1 * | 11/2002 | Shamam | 2/114 |
| 6,499,143 | B2 * | 12/2002 | Garza | 2/114 |
| 6,574,800 | B1 * | 6/2003 | Leger et al. | 2/114 |
| 6,647,552 | B1 * | 11/2003 | Hogan | 2/114 |
| 6,675,389 | B1 * | 1/2004 | Kublick | 2/2.17 |
| 6,792,622 | B2 * | 9/2004 | Graves | 2/114 |
| 7,010,812 | B1 * | 3/2006 | Cho et al. | 2/114 |
| D530,885 | S * | 10/2006 | Barthel | D2/720 |
| 7,305,716 | B1 * | 12/2007 | Richards | 2/114 |
| D579,178 | S * | 10/2008 | Snyder et al. | D2/840 |
| 7,526,816 | B2 * | 5/2009 | Shak | 2/114 |
| 7,596,814 | B1 * | 10/2009 | Corby et al. | 2/114 |

* cited by examiner

UPPER GARMENT FOR PATIENT

BACKGROUND OF THE INVENTION

1. Field of the Invention

The present invention relates to body garments and more particularly to an upper garment for patients.

2. Description of the Prior Art

Numerous medical conditions require attachment of lines to patients' arms. Such lines include intravenous ("IV") tubing, peripherally inserted central catheter ("PIC", or "PICC") lines, pulse-monitoring telemetry wiring, and the like. Frequently, it is necessary to attach such lines intermediately along a patient's arm; and it is frequently necessary, or at least desirable, to leave those lines attached to the patient's for an extended period of time.

For a patient who is wearing a long-sleeve shirt, in order to start an IV connection in the patient's arm, it is typically necessary either to remove the shirt entirely or, alternatively, to roll up the patient's sleeve, in order to expose the target connection area on the patient's arm. This can be difficult and/or uncomfortable for the patient, depending on, among other things, the design and fit of the sleeve, itself, as well as the condition of the patient.

For a patient who has initially rolled up a sleeve in order to expose an intermediate arm portion for connection of an IV line, the patient may be required to leave the sleeve rolled up after the line has been connected. This can be uncomfortable, inconvenient and impractical if the line is to remain connected to the patient's arm for a long period of time.

Similarly, for a patient who has initially removed a shirt in order to expose an intermediate arm portion for connection of an IV line, the patient may be required to leave the shirt off after the line has been connected. This, too, can be uncomfortable, inconvenient and impractical if the line is to remain connected to the patient's arm for a long period of time.

For a patient who already has a mid-arm PIC tap (i.e., without tubing connected thereto), it may be possible to put on, or take off, a long-sleeve shirt by gingerly and delicately pulling the sleeve over the PIC tap; but doing so can often be difficult, inconvenient, painful and/or dangerous.

Several upper garments have been proposed in the prior art for patients who have limited mobility, limited arm movement, or other medical conditions that make it difficult to put on or remove a long-sleeve garment.

U.S. Pat. No. 2,677,826, for example, discloses a shirt that is temporarily openable along its upper edge along the neckline, but is short-sleeved and cannot be donned by a patient already having a mid-arm IV connection.

U.S. Pat. No. 2,073,711 discloses a jacket having temporarily openable arm pits, but cannot be donned by a patient already having a mid-arm IV connection.

U.S. Pat. No. 2,736,900 discloses a hospital gown in which the front portion is separable from the back portion along each side, from the torso bottom, up to the arm pit, and from the arm pit to the distal end of the sleeve, but is short-sleeved, provides no covering for the wearer's forearm, and becomes completely detached/open on one side and one arm when separable portions separate.

U.S. Pat. No. 3,721,998 discloses a hospital scrub dress that is temporarily openable along its upper edge along the neckline, from the neck to the shoulder to the distal end of the sleeve, but is short-sleeved, cannot be donned as a pull-over garment by a patient already having a mid-arm IV connection, provides no covering for the wearer's forearm, and becomes completely detached/open on each arm when separable portions separate.

U.S. Pat. No. 4,258,440 discloses a shirt (FIG. 4) for a handicapped person, in which the front and back torso portions are temporarily separable from via a slit on each side from the bottom of the torso, up to the arm pit and to the distal end of the sleeve; Velcro fasteners are used to reattach the front and back panels of the shirt together. However, the garment is short-sleeved, provides no covering for the wearer's forearm, and the patient's arm inherently comes completely out of the garment whenever separable sleeve portions fully separate.

U.S. Pat. No. 4,644,589 discloses a shirt (FIGS. 1 & 2) for an arthritic person; the left and right halves of the torso portion are separable from the torso bottom up to the neck opening, and is closable using Velcro fasteners. However, the garment is sleeveless, provides no covering whatsoever for the wearer's arms.

U.S. Pat. No. 4,698,848 discloses a blouse for cardiac patients, having an openable front, and which uses Velcro fasteners for reattaching the front panel halves. However, the garment has short sleeves, cannot be donned by, or removed from, a patient already having a mid-arm IV connection, and provides no covering for the wearer's forearm.

U.S. Pat. No. 4,964,173 discloses a two-piece dignity gown that has front and back panels, which are attached to each other with Velcro. However, the garment has short sleeves, provides no covering for the wearer's forearm, and the patient's arm inherently comes completely out of the garment whenever separable sleeve portions fully separate.

U.S. Pat. No. 5,062,159 discloses a hospital gown, in which the front and back torso portions are temporarily separable from via a slit on each side from the bottom of the torso, up to the arm pit and from the arm pit to the distal end of the sleeve. However, the garment has short sleeves, provides no covering for the wearer's forearm, and the patient's arm inherently comes completely out of the garment whenever separable sleeve portions fully separate.

U.S. Pat. No. 5,097,535 discloses center-torso buttoned pajama shirt with sleeves that are separable (principally on their front/forward portions) for their entire length. However, the garment cannot be readily donned as a pull-over garment by a patient already having a mid-arm IV connection, and the patient's arm inherently comes completely out of the garment whenever separable sleeve portions fully separate.

U.S. Pat. No. 5,222,258 discloses a hospital garment (FIG. 1) in which the top portion of the sleeve is temporarily separable from the shoulder to the distal end of the sleeve, but is short-sleeved and cannot be donned by, or removed from, a patient already having a mid-arm IV connection.

U.S. Pat. No. 5,325,583 discloses a vest that is temporarily openable on its side, from the arm hole to the waist; front and back panels are re-attachable by Velcro fastener. However, the garment is sleeveless and therefore provides no covering for the wearer's arm(s).

U.S. Pat. No. 5,392,466 discloses a sweatshirt-type garment for patients, wherein the front portion is temporarily separable from the back portion on one side, from the bottom of the torso up to the arm pit, and from the arm pit to the distal end of the sleeve. However, the patient's arm inherently comes completely out of the garment whenever the separable sleeve portion fully separates.

U.S. Pat. No. 5,564,123 discloses a single piece upper garment having, on one side, a torso and first sleeve that is temporarily separable from the bottom of the torso, up to the arm pit, and from the arm pit to the distal end of the sleeve; and, on the other side, has a second sleeve that is temporarily separable from the neck opening to the distal end of the sleeve. However, the garment has short sleeves, provides no covering for the wearer's forearm, and the patient's arm inherently comes completely out of the garment whenever separable sleeve portions fully separate.

U.S. Pat. No. 5,564,126 discloses a patient garment that is temporarily openable from the bottom of the torso, up to the shoulder, and from the shoulder to the distal end of the sleeve.

U.S. Pat. No. 5,642,526 discloses a jump suit-type garment having a temporarily openable ventilation slit that extends from the upper portion of the torso, approximately through the arm pit, and terminates partway down the sleeve. However, the patient's arm inherently comes completely out of the garment whenever separable sleeve portions fully separate.

U.S. Pat. No. 5,920,904 discloses a torso garment for a person with shoulder problems, wherein the front panel is temporarily separable from the back panel, from the bottom of the torso up to the arm pit. However, the garment is sleeveless, and therefore provides no covering for the wearer's forearm.

U.S. Pat. No. 6,119,270 discloses a jacket that is temporarily openable from the bottom front of the torso up to the arm pit, and from the arm pit to the distal end of the sleeve. However, the patient's arm inherently comes completely out of the garment whenever separable sleeve portions fully separate U.S. Pat. No. 6,484,321 discloses a hospital gown in which a the top of a sleeve is temporarily openable from the shoulder to the distal end of the sleeve. However, this garment is short-sleeved, cannot be donned as a pull-over garment by a patient already having a mid-arm IV connection, provides no covering for the wearer's forearm, and the patient's arm inherently comes completely out of the garment whenever separable sleeve portions fully separate.

U.S. Pat. No. 6,647,552 discloses a medical dignity garment in which a sleeve is temporarily separable from the arm pit to the distal end of the sleeve. However, the patient's arm inherently comes completely out of the garment whenever separable sleeve portions fully separate.

In addition to the above-mentioned problems in the prior art, such patient garments generally do not have the look of "normal" casual wear (but instead typically have the look of "hospital wear"), are not comfortable for the wearer, often are not suitable for wearing outdoors, and are often difficult to put on and take off.

There is, then, a need for an upper body garment, for a patient having a mid-arm IV tube connection, that overcomes all of the above mentioned problems in the prior art.

BRIEF SUMMARY OF THE INVENTION

In view of the foregoing, an encompassing object of the present invention is to provide a pull-over type, long-sleeve, upper body garment that is adapted to be comfortably worn by a patient, while providing patient care access to the wearer's mid-arm region.

It is another object of the present invention to provide a pull-over, long-sleeve garment of the character described that can be readily donned by a patient to whom a mid-arm IV line is connected, without necessitating removal of the IV line.

It is another object of the present invention to provide a pull-over, long-sleeve garment of the character described in which an IV line (or the like) can either be attached to or detached from a wearer's mid-arm region, without requiring that the garment be removed and without requiring that the sleeve of the garment be rolled up. In the present invention, access to the wearer's mid-arm region is gained by temporarily opening a slit in the upper (i.e., proximal) portion of the sleeve.

It is another object of the present invention to provide a pull-over, long-sleeve garment of the character described garment that has a continuous, inseparable, lower (i.e., forearm-to-wrist) sleeve portion through which a wearer must insert his/her hand, wrist and forearm in order to don the garment, so that the sleeve of the garment cannot "fall off" of the wearer's arm when the separable components of the garment are completely separated.

It is another object of the present invention to provide a pull-over, long-sleeve garment of the character described garment having a continuous, inseparable, lower (i.e., forearm-to-wrist) sleeve portion through which a wearer must insert his/her hand, wrist and forearm in order to don the garment, so that the sleeve and the overall garment will substantially have the feel and the look of "ordinary" (i.e., non-hospital) casual wear.

It is another object of the present invention to provide a pull-over, long-sleeve garment of the character described garment that has a partially closeable slit that extends continuously from the bottom of the torso portion upwardly to the arm pit portion, and thence from the arm pit portion downwardly along the arm, and terminating at the mid-arm portion of the sleeve.

It is a further object to provide an embodiment of the present invention that substantially has the look and the feel of a long-sleeve sweatshirt, and which can be readily donned, removed and worn by a person to whom a mid-arm IV line is attached, without necessitating removal of the IV line. It is a further object to provide such an embodiment of the invention, wherein the sweatshirt can be readily donned by, or removed from, a person to whom a mid-arm IV is attached, without the assistance of another person.

Other objects, features and advantages of the present invention will become readily apparent from a consideration of the attached drawings and the ensuing detailed description thereof.

REFERENCE NUMERALS IN DRAWINGS

Figure 1:
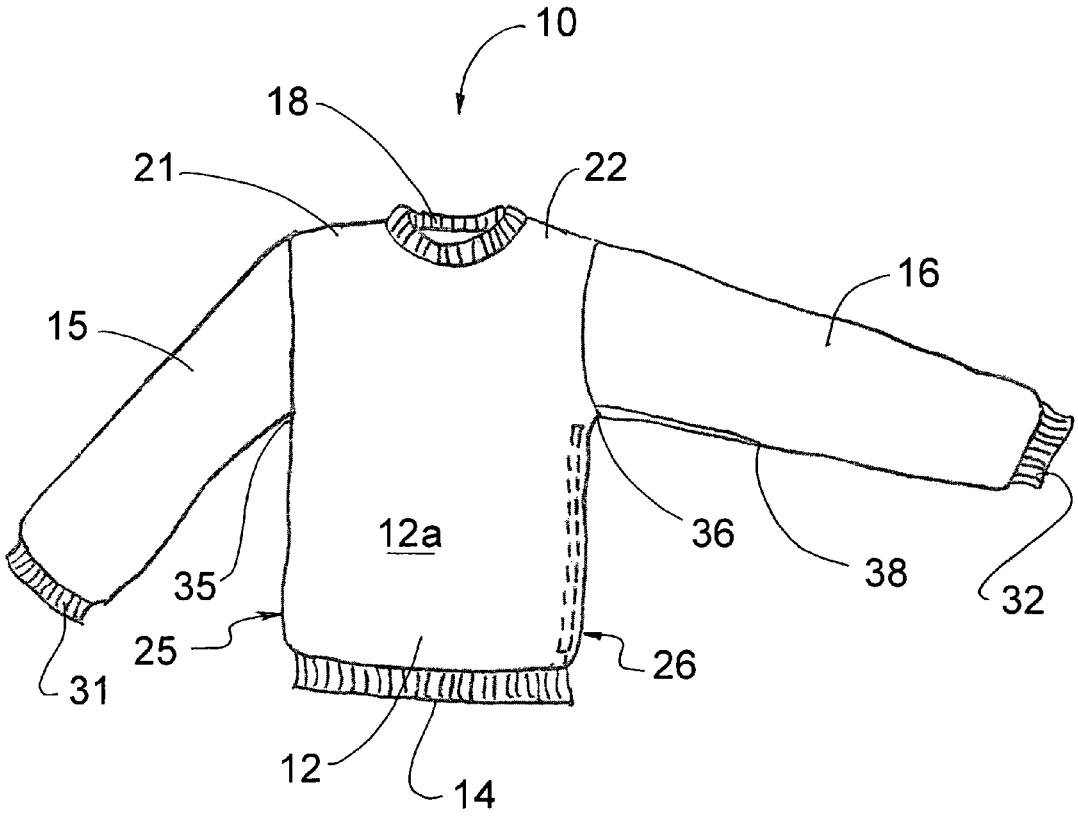
FIG. 1 is a front view of an upper body garment constructed in accordance with the present invention, showing the garment in the closed condition.

S Slit
- S1 Segment of the slit in the upper portion of sleeve

10 Upper body garment
12 Garment body
- 12*a* Front half body portion
- 12*b* Back half body portion

14 Garment body lower end
15 Right sleeve
16 Left Sleeve
- 16*a* Upper portion of left sleeve
- 16*b* Lower end of left sleeve

18 Neck
21 Right shoulder
22 Left shoulder
25 Right lateral side of front body portion

26 Left lateral side of front body portion
29 Right lateral side of back body portion
30 Left lateral side of back body portion
31 Distal end of right sleeve
32 Distal end of left sleeve
35 Right arm pit
36 Left arm pit
38 End Point of slit
40*a*, 40*b* Mating fastener members

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 2:
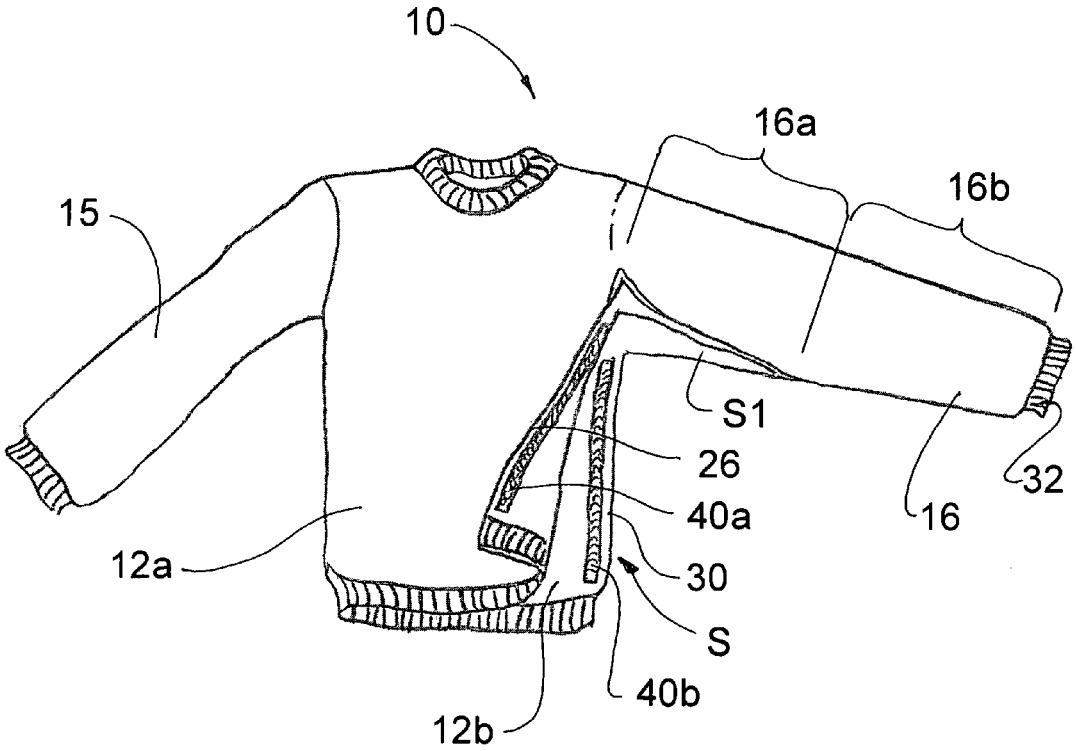
FIG. 2 is a back view of the upper body garment illustrated in FIG. 1, showing the garment in the closed condition.
Figure 3:
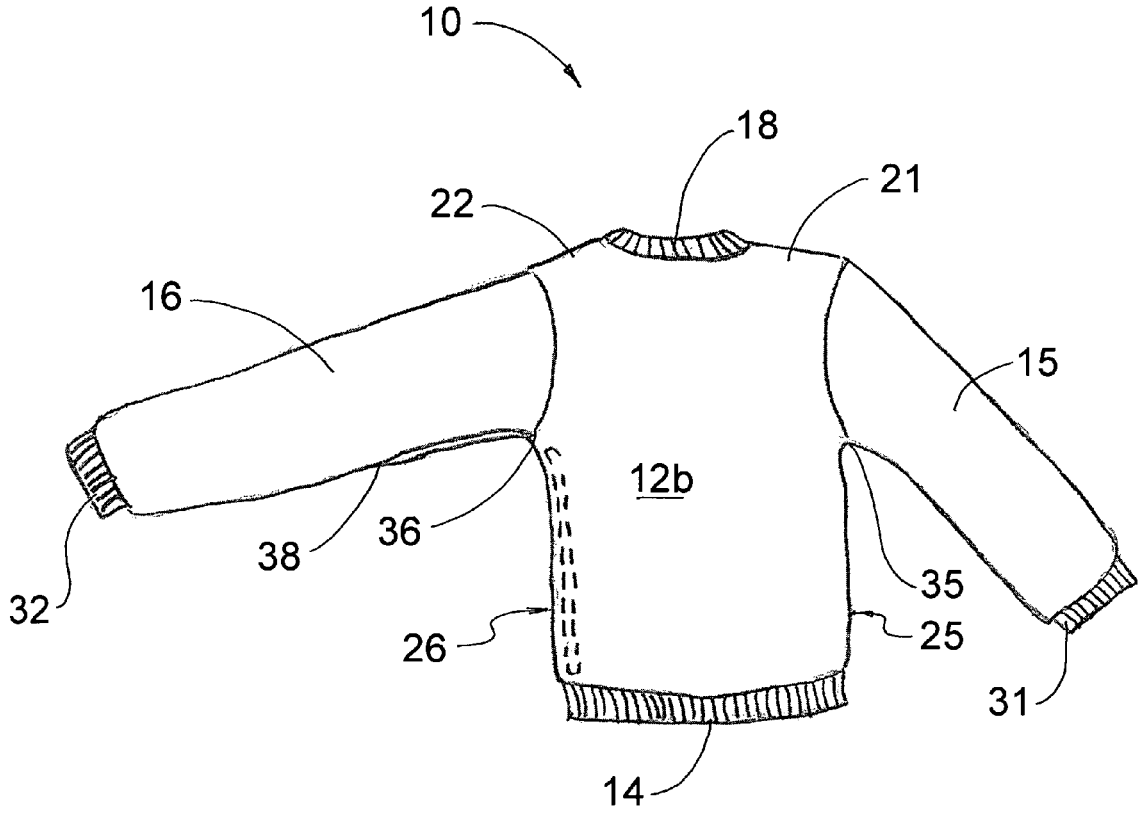
FIG. 3 is a front view of the upper body garment illustrated in FIG. 1, showing the garment in an open condition.

With reference initially to drawing FIGS. 1-3, the present invention is an upper body garment that is adapted to be worn as outerwear (i.e., shirt or jacket) by a person to whom medical lines are, or may become, attached to one of the wearer's arms. By way of example, the following describes a preferred embodiment of the present invention wherein the garment is specifically adapted to be worn by a patient who has, or who may come to have, medical lines attached to the wearer's left arm, intermediately between the wearer's wrist and shoulder. It will be understood, however, that modified embodiments of the present invention could similarly be constructed to be worn instead by patients to whom medical lines are, or may become, attached instead to a patient's right arm, or to both arms.

As used herein, the term "medical lines" refers to any tubing (such as IV tubing and PIC lines), wiring (such as heart rate-monitoring telemetry wiring), and similar lines that are commonly connected to patients' arms.

An upper garment 10 in accordance with the present invention generally comprises a garment body 12 and two long sleeves, namely a right sleeve 15 and a left sleeve 16. As used herein, the term "long sleeve" refers to a garment sleeve that, when worn in an unrolled-up fashion by a person, nominally extends from the wearer's shoulder and arm pit approximately to the wearer's wrist or hand. As used herein, the term "long sleeve shirt" includes, but is not limited to, any shirt whose sleeve length (as measured from the bottom of an arm pit to the distal end of the sleeve) is at least as long as the side of the body of the shirt (as measured from the bottom of the arm pit to the tail of the shirt).

Garment body 12 has a neck 18; right 21 and left 22 shoulder portions between neck 18 and the tops of the right and left sleeves 15, 16, respectively; and a garment body lower end 14.

Garment body 12 comprises a front half body portion 12*a* and a back half body portion 12*b*. Front half body portion 12*a* has right and left lateral sides 25, 26, respectively. Back half body portion 12*b* has left and right lateral sides 29, 30, respectively.

Front half body potion 12*a* is permanently attached (e.g., sewn) to back half body portion 12*b* at one (e.g., the right) lateral side of the garment and at both the right and left shoulder portions 21, 22. In the preferred embodiment of the invention, the front and back half body portions 12*a*, 12*b* are attached to each other at one (e.g., right) lateral side in a seamless manner (as per a sweatshirt or a Tee shirt); but in modified embodiments of the invention there may be a seam along the line(s) of attachment of front half body portion 12*a* to back half body portion 12*b*.

It will be understood, then, that in the preferred embodiment of the invention, front and back half body portions 12*a*, 12*b* are not separable or "openable" from each other on one (e.g., the right) side of the garment 10.

Both left sleeve 16 and right sleeve 15 are permanently attached (e.g., sewn) to garment body 12.

In the preferred embodiment of the invention, a first (e.g., right) sleeve 15 is permanently attached (e.g., sewn) to garment body 12 around its (i.e., right sleeve's 15) entire circumference, and the girth of the sleeve 15 is substantially continuous (i.e., inseparable and without openings) from the arm pit 35 to the distal end 31 of sleeve 15.

It will be appreciated, then, that in order for a person to put garment 10 on, the garment must be pulled over the person's head, so that the wearer's head and neck protrude through the neck opening 18; and the wearer must insert his/her hand and into the top of the first (e.g., right) sleeve 15, and pass his/her hand through the entire length of that sleeve 15.

It will further be understood that in order for a wearer to take garment 10 off, the garment must be pulled over the wearer's head, so that the wearer's head can be pulled through neck opening 18, and so that the wearer's right hand and arm can be withdrawn through the entire length of right sleeve 15.

On the left side of the garment, the front and back half body portions 12*a*, 12*b* are temporarily separable from of each other, and the underside of the upper end of sleeve 16 is temporarily openable, via a continuous slit (S) in the garment. Slit (S) runs continuously from the garment body lower end 14, upwardly along the side of garment body 12 to (left) arm pit 36, thence downwardly from arm pit 36 along sleeve 16, and terminates intermediately between the arm pit 36 and the distal end 32 of the sleeve. In the preferred embodiment of the invention, one end 38 of slit (S) is approximately at the midpoint of sleeve 16, in an area approximately corresponding to where the garment wearer's elbow would typically be located.

In the body of the garment, the edges of mating left lateral sides 26, 30 of front and back half body portions 12*a*, 12*b*, respectively, make up the opposite sides of slit (S). In the preferred embodiment of the invention, the edges of the slit (S) are serged from the bottom 14 of the garment body to the middle of sleeve 16.

Mating fastening elements 40*a*, 40*b* are provided at left lateral sides 26, 30 of front and back half body portion 12*a*, 12*b*, respectively, for temporarily attaching left lateral sides 26, 30 of the front and back half body portions 2*a*, 12*b* to each other. In the preferred embodiment of the invention, continuous strips of mating ⅝" VELCRO hook-and-loop fasteners 40*a*, 40*b* are sewn along the left lateral sides 26, 30 of front and back half body portions 12*a*, 12*b*, respectively, to within ½" of arm pit 36. Preferably, the harder (i.e., less pliable) of the mating VELCRO fastener members 40*a* should be attached to front half body portion 12*a*; and the softer (i.e., more pliable) fastener member 40*b* should be attached to back half body portion 12*b*.

The segment (S1) of the slit in the sleeve extends longitudinally downwardly on (left) sleeve 16, from arm pit 36 approximately to the midpoint 38 of the sleeve. Preferably, segment (S1) of the slit in the sleeve is located on the underside of the sleeve (that is, the side of the sleeve that nominally faces the near side of the garment body). In the preferred embodiment of the invention, no fasteners are provided in (left) sleeve 16 for closing the segment (S1) of the slit in the sleeve. Thus, there is always an open slit (S1) in the upper end of sleeve 16, through which access to the wearer's upper arm is always provided. It will be appreciated, however, that because the segment (S1) of the slit in the sleeve is preferably located on the underside of the upper portion of sleeve 16, the opening in the sleeve may not be visible or apparent to a casual observer when the garment 10 is being worn by a person.

The surface area of (left) sleeve 16 is preferably substantially continuous (i.e., without openings) between the end 38 of the slit (S) and the distal end 32 of the sleeve.

As discussed above, in order for a person to put the garment 10 on, the garment must be pulled over the person's head, so that the wearer's head and neck protrude through neck opening 18; and the wearer must insert one (e.g., the right) hand into the top of a first (e.g., right) sleeve 15, and pass that hand through the entire length of that sleeve 15. The wearer must additionally pass his/her second (e.g., left) hand through the lower portion 16*b* of the other (e.g., left) sleeve 16. It should be understood that, by temporarily separating mating fastener members 40*a*, 40*b*, slit S becomes open in the entire left side of the garment body 12 and the upper portion 16*a* of the adjacent sleeve; and the wearer can then easily pass his/her left hand through the lower portion 16*b* of the sleeve via the segment (S1) of the slit at the top of upper portion 16*a* of the sleeve.

Once the wearer has pulled the garment on over his/her head, passed one arm through the first (e.g., right) sleeve 15, and passed his/her second (e.g., left) hand through the lower portion 16*b* of sleeve 16, the mating left sides 26, 30 of front and back body portions 12*a*, 12*b* of the garment can then be fastened together by way of fastener members 40*a*, 40*b*, thereby closing the slit in the lateral side of the garment body 12.

In a similar (but reverse) manner, a wearer can easily take the garment 10 off by first separating the mating left sides 26, 30 of front and back body portions 12*a*, 12*b* of the garment, then withdrawing his/her left hand from the lower portion 16*b* of the left sleeve through the opening provided by slit (S), then pulling the garment over the wearer's right arm and head.

It can be understood from the above description that, for a patient who is wearing an upper body garment 10 that is fabricated in accordance with the present invention, medical lines can subsequently be connected to, and thereafter remain connected to, the wearer's (left) arm without necessitating rolling up of the patient's (left) sleeve and without necessitating removal of the garment.

It can additionally be understood that, for a patient who is initially wearing an upper body garment 10 that is fabricated in accordance with the present invention, and to whose arm medical lines are connected, the garment can be removed from the patient without necessitating the disconnection or removal of the medical lines from the patient's arm.

As discussed above, in order to put the garment 10 on, a wearer needs to pass one of his/her hands (e.g., his/her left hand) through the lower portion 16*b*, and only the lower portion 16*b*, of long sleeve 16. By inserting a hand (and forearm) through the "unopenable" lower portion 16*b* of the long sleeve 16, the wearer does not have to search for, or wrestle with, loose ends of the sleeve when putting the garment on. In addition, because the lower portion 16*b* of the long sleeve is continuous and encircles the wearer's forearm, the wearer need not worry that the garment or the sleeve could "fall off", as could be the case if a slit were, instead, to extend all the way from the bottom of the garment body (i.e., the waist) to the arm pit and the whole length of the sleeve. It will also be appreciated from an understanding to the above description of the present invention that, because the lower portion 16*b* of the long sleeve is always "closed" (i.e., it is not separable), the segment of the slit (S1) in the upper portion of the sleeve can always remain "open", without disadvantageously affecting the performance or the appearance of the garment.

It has therefore been shown that the present invention provides an upper body garment that provides a patient/wearer with comfort, warmth, personal modesty, ease of donning, ease of removal, style and protection from the elements that is typically unavailable for hospital patients or outpatients to whom mid-arm medical lines are, or are to be, connected.

Figure 4:
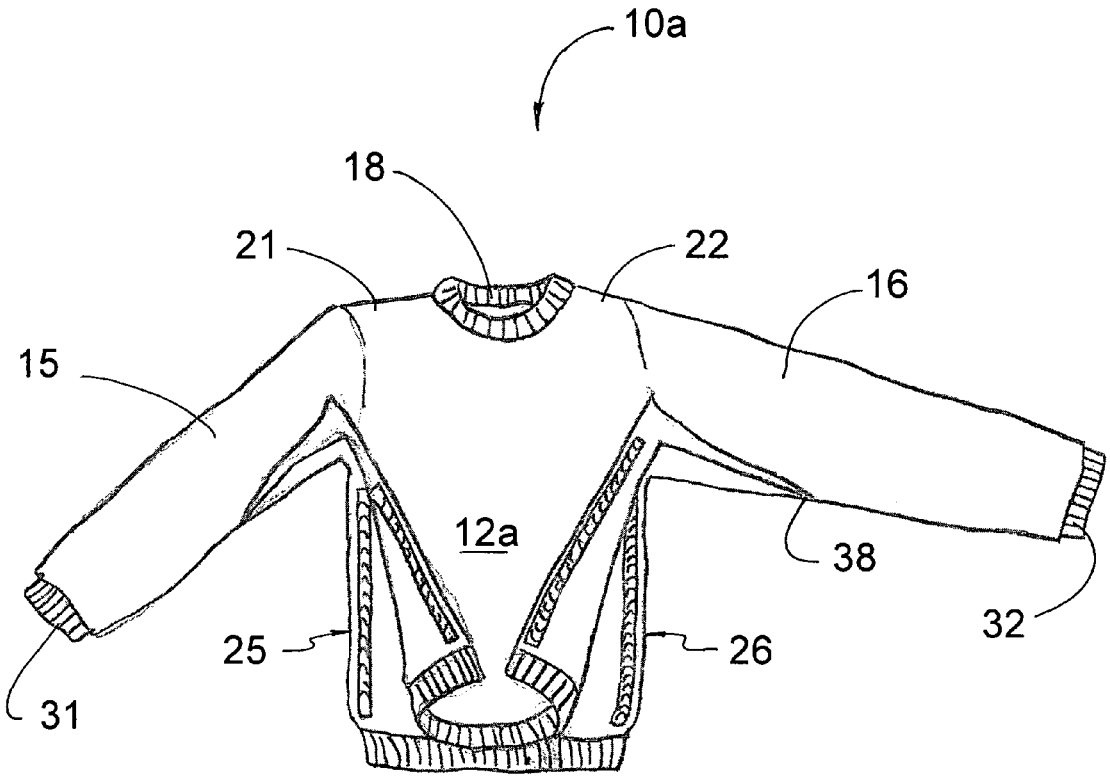
FIG. 4 is a front view of a modified embodiment of the present invention, showing the modified garment in an open condition.

While the above description contains many specificities, these should not be construed as limitations on the scope of the invention, but rather as an exemplification of one preferred embodiment thereof. Many other variations are possible, for example:

- The garment can be fabricated such that slit S is located on the right side of the garment, and the left side of the garment is inseparable and non-openable, thereby providing IV line access to a wearer's right arm;
- The garment can be fabricated such that slits are located on both the right and the left side of the garment, as illustrated in FIG. 4, thereby providing IV line access to a wearer's right arm and left arm;
- One or more opening (such as a buttonable longitudinal slit in the cuff of the sleeve, as per a common dress shirt) can be provided at or near the distal end of the sleeve, in which case the surface of the sleeve may not be continuous and without openings for its entire length between the end 38 of slit (S) and the distal end 32 of the sleeve;
- Slit segment (S1), which preferably passes through the bottom of the arm pit, may extend downward along the sleeve along the underside of the sleeve, or toward the back or front of the sleeve;
- Slit end 38 can located in the sleeve above, below or at the wearer's elbow;
- Fasteners other than VELCRO, (including, for example, snaps, buttons and lacing) can be used for temporarily attaching the lateral sides of the garment body to each other;
- Multiple segments of VELCRO can be used in place of continuous VELCRO fastener strip;
- One or more fasteners may be provided for temporarily closing the segment S1 of the slit in the upper portion of the sleeve;

Accordingly, the scope of the invention should be determined not by the embodiment(s) illustrated, but by the appended claims and their legal equivalents.

What is claimed is:

1. An upper body garment for a patient, comprising:

a garment body and first and second sleeves, said first sleeve being attached to said garment body and forming a first arm pit at a point of attachment to said garment body;

and said second sleeve being attached to said garment body and forming a second arm pit at a point of attachment to said garment body;

and each of said first and second sleeves having a hand opening at its distal end;

said garment body having a neck opening at its upper end and a torso opening at its lower end;

a first shoulder portion between said neck opening and said first sleeve;

and a second shoulder portion between said neck opening and said second sleeve;

a front half body portion and a back half body portion, said front half body portion having opposite first and second lateral sides, and said back half body portion having opposite first and second lateral sides;

wherein said first lateral side of said front half body portion is permanently attached to said first lateral side of said back half body portion;

and wherein said front half body portion is permanently attached to said back half body portion at said first and second shoulder portions;

and wherein said second lateral side of said front half body portion is temporarily separable from said second lateral side of said back half body portion between said garment body lower end and said second arm pit, thereby defining a first slit segment between said garment body lower end and said second arm pit;

and further comprising an elongated opening in said second sleeve, said elongated opening in said second sleeve extending from said second arm pit to a termination point intermediately between said second arm pit and a distal end of said second sleeve, and thereby defining a second slit segment between said second arm pit to said termination point;

wherein said second sleeve is continuous and permanently unopenable between said termination point and said hand opening at said distal end of said second sleeve; and, wherein said first and second slit segments mutually define a continuous slit between said garment body lower end and said termination point.

2. The upper body garment according to claim 1, further comprising:

fastening means for temporarily attaching said second lateral side of said front half body portion to said second lateral side of said back half body portion.

3. The upper body garment according to claim 2, wherein said fastening means comprises mating first and second hook-and-loop fastener members, said first hook-and-loop fastener member being attached to said second lateral side of said front half body portion, and said second hook-and-loop fastener member being attached to said second lateral side of said back half body portion.

4. The upper body garment according to claim 3, wherein the length of said second sleeve, as measured between said second arm pit and said distal end of said second sleeve, is at least a long as a side of said garment body, as measured between said second arm pit and said garment body lower end;

and wherein said termination point is approximately midway between said second arm pit and said distal end of said second sleeve.

5. An upper body garment for a patient, comprising:

a garment body and first and second sleeves, said first sleeve being attached to said garment body forming a first arm pit at a point of attachment to said garment body;

and said second sleeve being attached to said garment body and forming a second arm pit at a point of attachment to said garment body;

and each of said first and second sleeves having a hand opening at its distal end;

said garment body having a neck opening at its upper end and a torso opening at its lower end;

a first shoulder portion between said neck opening and said first sleeve, and a second shoulder portion between said neck opening and said second sleeve;

a front half body portion and a back half body portion, said front half body portion having opposite first and second lateral sides, and said back half body portion having opposite first and second lateral sides;

wherein said front half body portion is permanently attached to said back half body portion at said first and second shoulder portions;

and wherein said first lateral side of said front half body portion is temporarily separable from said first lateral side of said back half body portion between said garment body lower end and said first arm pit, thereby defining a first garment body slit segment between said garment body lower end and said first arm pit;

and further comprising an opening in said first sleeve, said opening in said first sleeve extending from said first arm pit to a first termination point intermediately between said first arm pit and a distal end of said first sleeve, and thereby defining a first sleeve slit segment extending between said first arm pit and said first termination point;

wherein said first garment body slit segment and said first sleeve slit segment mutually define a continuous first slit between said garment body lower end and said first termination point;

and wherein said first sleeve is continuous and permanently unopenable between said first termination point and said hand opening at said distal end of said first sleeve;

and wherein said second lateral side of said front half body portion is temporarily separable from said second lateral side of said back half body portion between said garment body lower end and said second arm pit, thereby defining a second garment body slit segment between said garment body lower end and said second arm pit;

and further comprising an opening in said second sleeve, said opening in said second sleeve extending from said second arm pit to a second termination point intermediately between said second arm pit and a distal end of said second sleeve, and thereby defining a second sleeve slit segment extending between said second arm pit and said second termination point;

wherein said first garment body slit segment and said second sleeve slit segment mutually define a continuous second slit between said garment body lower end and said second termination point;

wherein said second sleeve is continuous and permanently unopenable between said second termination point and said hand opening at said distal end of said second sleeve;

and further comprising fastening means for temporarily attaching said first lateral side of said front half body portion to said first lateral side of said back half body portion;

and comprising fastening means for temporarily attaching said second lateral side of said front half body portion to said second lateral side of said back half body portion.

* * * * *